US006098578A

United States Patent [19]

Schuko

[11] Patent Number: 6,098,578

[45] Date of Patent: Aug. 8, 2000

[54] INTERNAL COMBUSTION ENGINE WITH IMPROVED GAS EXCHANGE

[76] Inventor: Leonhard E. Schuko, 100 Roselena Drive, Schomberg, Ontario, Canada, L0G 1T0

[21] Appl. No.: 09/306,382

[22] Filed: May 6, 1999

[51] Int. Cl.[7] ..... F02B 75/26; F01B 3/02

[52] U.S. Cl. ..... 123/56

[58] Field of Search ..... 123/56.1, 56.2, 123/56.5, 56.8, 56.9

[56] References Cited

U.S. PATENT DOCUMENTS

| | | | |
|---|---|---|---|
| 2,630,100 | 3/1953 | Fulke . | |
| 5,218,933 | 6/1993 | Ehrlich | 123/56.2 |

FOREIGN PATENT DOCUMENTS

| | | |
|---|---|---|
| 0 357 291 | 3/1990 | European Pat. Off. . |
| 1039541 | 10/1953 | France . |
| 118131 | 3/1918 | United Kingdom . |
| WO 87/00243 | 1/1987 | WIPO . |

*Primary Examiner*—Marguerite McMahon
*Attorney, Agent, or Firm*—Pillsbury Madison & Sutro LLP

[57] ABSTRACT

An internal combustion engine of the opposed piston type valved by the passage of the pistons beyond inlet and outlet ports at opposite ends of the cylinders. The motion transmitting mechanisms for the opposed pistons are operable to move the opposed pistons within each cylinder through a successive three cycle repeating movement which includes (1) an operative power cycle, (2) a gas exchange cycle, and (3) an operative compression cycle. A pump assembly is associated with each piston operable to cause a fresh charge of gas to be displaced by the pump assemblies associated with the opposed pistons of each cylinder during an operative cycle of the associated pistons therein and confined to move directly into the open inlet port of one other cylinder generally simultaneously with the gas exchange cycle of the opposed pistons associated therewith so as to thereby effect the exchange of the combusted gases therein with a fresh charge under relatively low pressure conditions during a time period which is generally equal to the time of the operative cycle.

5 Claims, 7 Drawing Sheets

INTERNAL COMBUSTION ENGINE WITH IMPROVED GAS EXCHANGE

This invention relates to internal combustion engines and more particularly to internal combustion engines of the opposed piston type.

Opposed piston engines of the kind herein contemplated include a series of cylinders, each of which has an inlet port at one end and an outlet port at an opposite end. An inlet piston is mounted in each cylinder to move from an end position communicating the inlet port with a central working portion of the cylinder into the cylinder past the inlet port into a combustion position near the center of the cylinder and then back into the end position. An outlet piston is mounted in each cylinder to move substantially simultaneously with the inlet piston from an end position communicating the outlet port with the cylinder past the outlet port into a combustion position near the center of the cylinder and then back into the end position. The movement of the inlet and outlet pistons are connected in motion-transmitting relation with an output shaft so as to be moved cyclically as the output shaft rotates.

In some instances, the cylinders are spaced in a row and the motion-transmitting mechanism is in the form of parallel inlet and outlet crank shafts connected to the inlet and outlet pistons by inlet and outlet connecting rods. In other instances, the cylinders are spaced annularly about a central output shaft and the motion-transmitting mechanisms are in the form of wobble or swash plate mechanisms imparting simple harmonic motion to the pistons.

Instead of wobble or swash plate mechanisms, many opposed piston engines utilize annular inlet and outlet cams movable with the central shaft and driving inlet and outlet cam followers connected with the inlet and outlet pistons. The utilization of cams enables movements to be imparted to the inlet and outlet pistons which are different from the simple harmonic motion which results from a crank-connecting rod or wobble or swash plate mechanism. Indeed, cam movements which depart drastically from simple harmonic motion have been proposed. See, for example, U.S. Pat. Nos. 1,788,140 and 1,808,083 which provide non-simple harmonic cam motions which provide a five-cycle movement simulating a conventional four-cycle movement. Drastic departures of this type destroy one inherent advantage of opposed pistons; namely, the inherent dynamic balance achieved by moving the inlet and outlet pistons simultaneously toward and away from each other. Cams allow desired equal and opposite movements of the pistons which are different from simple harmonic motion. Even with the use of simple harmonic motion, it is possible to slightly displace the movement of inlet piston with respect to the outlet piston to ensure that the outlet port is opened before the inlet port at the end of the power stroke or cycle.

From the above, it is evident that most known opposed piston engines of the type herein contemplated are essentially two-cycle engines which rely upon gas displacement in a short interval between the power stroke or cycle and the compression stroke or cycle to exchange the spent combusted gas charge with a fresh gas charge.

Aside from the inherent balancing of the piston movements, a basic advantage of opposed piston engines compared with the more conventional two-cycle engines is the very favorable gas flow during exchange which is unidirectional throughout the cross-section of the cylinder from one end to the other. Two-cycle engines which are valved by moving a single piston past inlet and outlet ports in one end of the cylinder require gas scavenging along a relatively tortuous path as compared with the unidirectional straight through flow provided in an opposed piston engine of the type herein contemplated.

Engines which accomplish charge exchange by gas movement are commonly referred to as two-cycle engines to distinguish them from four-cycle engines which effect charge exchange by positive displacement of the piston through an exhaust stroke or cycle and an intake stroke or cycle between the power stroke or cycle and compression stroke or cycle. This terminology leaves the gas charge exchange engine with just two operative cycles, namely, power and compression. But, in-between the operative power and compression cycles, charge exchange must be accomplished. Whatever time is allotted to charge exchange which must be performed with open valves lessens the power and compression cycles which must be performed with closed valves. The prior art efforts have been directed mostly to minimizing exchange time by increasing the inlet pressure of the incoming gas as by raising the inlet manifold pressure created by the outward piston movement during the power cycle or by an added supercharger. Both of these pressurizing methods of gas exchange take work which diminishes the ability of the engine to deliver its work to the output shaft. There exists a need to provide an engine operating on a charge exchange basis, similar to conventional two-cycle engines, which is enabled to effect charge exchange in a more efficient manner.

An object of the present invention is to fulfill the above-described need. In accordance with the principles of the present invention, this objective is achieved by providing an internal combustion engine which includes a housing with a structure within the housing which defines a plurality of spaced cylinders with their axes parallel. Each of the cylinders includes an inlet end portion having an inlet port therein, a central working portion and an outlet end portion having an outlet port therein. An inlet piston is mounted in each cylinder movable into sealing relation with the associated cylinder from an inlet end position wherein the inlet port thereof communicates with the working portion thereof in an axial direction away from the inlet end position into an inlet port cut-off position wherein the inlet piston cuts off communication of the inlet port thereof with the working portion thereof and beyond into the working portion thereof. An outlet piston is mounted in each cylinder movable into sealing relation with the associated cylinder from an outlet end position wherein the outlet port thereof is communicated with the working portion thereof in an axial direction away from the outlet end position into an outlet port cut-off position wherein the outlet piston cuts off the communication of the outlet port thereof with the working portion thereof and beyond into the working portion thereof. An output shaft is carried by the housing for rotational movement with respect thereto. An inlet motion-transmitting mechanism is drivingly connected between the output shaft and each inlet piston for causing each inlet piston to move cyclically between the inlet end position thereof and a combustion position within the associated cylinder thereof in conjunction with the rotational movement of the output shaft. An outlet motion-transmitting mechanism is drivingly connected between the output shaft and each outlet piston for causing each outlet piston to move cyclically between the outlet end position thereof and a combustion position within the associated cylinder thereof in conjunction with the rotational movement of the output shaft. The inlet and outlet motion-transmitting mechanisms are interrelated and configured to move the inlet and outlet pistons within each cylinder through a successive three-cycle repeating movement which includes (1) an operative power cycle wherein the inlet and outlet pistons are moved by the combustion of a combustible gas charge therein axially outwardly from the combustion positions until the gas charge is communicated with the outlet port by the outlet piston moving beyond the outlet port cut-off position thereof within the cylinder into the respective cut-off positions thereof defining a maximum volume condition, (2) a gas exchange cycle wherein the outlet and inlet pistons are moved between the respective cutoff positions thereof and the respective end positions thereof to enable a combusted gas charge to be exhausted through the open outlet port and a fresh gas charge to be moved through the open inlet port thereof, and (3) an operative compression cycle wherein the inlet and outlet pistons are moved toward one another beyond the respective port cut-off positions thereof into the combustion positions to trap a fresh gas charge and compress the same. The inlet and outlet pistons have pump piston structure fixed to move therewith associated with each of the cylinders. Cooperating pump structure is operatively associated with the pump piston structure to cause a fresh charge of gas to be displaced by the pump piston structure associated with each cylinder during an operative cycle of the associated pistons therein and confined to move directly into the open inlet port of only one other cylinder generally simultaneously with the gas exchange cycle of the inlet and outlet pistons associated therewith so as to thereby effect the exchange of the combusted gases therein with a fresh charge under relatively low pressure conditions during a time period which is generally equal to the time of the operative cycle.

From the above, it is evident that the principles of the present invention achieve more efficient charge exchange in two important ways. First, by increasing the extent of the gas exchange cycle to generally equal that of an operative cycle and, second, by effecting gas exchange with more of a relatively low pressure positive displacement movement of air somewhat similar to a four-stroke engine than by a highly pressurized burst of gas. In its broadest aspects, the present invention contemplates that the opposed pistons can be moved by motion-transmitting mechanisms, such as crank-con rod mechanisms or wobble swash plate mechanisms which impart simple harmonic motion to the pistons. Where simple harmonic motion is utilized, the increased gas exchange cycle is obtained by simply extending the inlet and outlet ports more toward the center of the cylinder. Extending the ports in this fashion, of course, reduces the compression and power cycles. Moreover, use of simple harmonic motion producing mechanisms necessitates operative and gas exchange cycles which are substantially equal making it necessary, in order to obtain the pumping interrelation between cylinders, to limit the number of cylinders to three or a multiple of three.

It is greatly preferred in accordance with the principles of the present invention to utilize cam and cam follower motion-transmitting mechanisms because the piston movements can be selectively varied to set independent operative cycles and to achieve greater efficiency.

The use of cam mechanisms enables three or six cylinder engines having generally equal operative and gas exchange cycles to be built with full operative strokes uneffected by the extent of the gas exchange cycle. Moreover, the four and eight cylinder engines having the necessary inter gas displacement between cylinders by making only one of the operative cycles generally equal to the gas exchange cycle and the other operative cycle of generally double extent. Another advantage of the use of cams is that other cycle efficiencies can be achieved including a dwell period during combustion and an increased expansion-compression ratio beyond one.

DETAILED DESCRIPTION OF THE EMBODIMENT OF THE INVENTION SHOWN IN FIGS. 1–3

Figure 1:
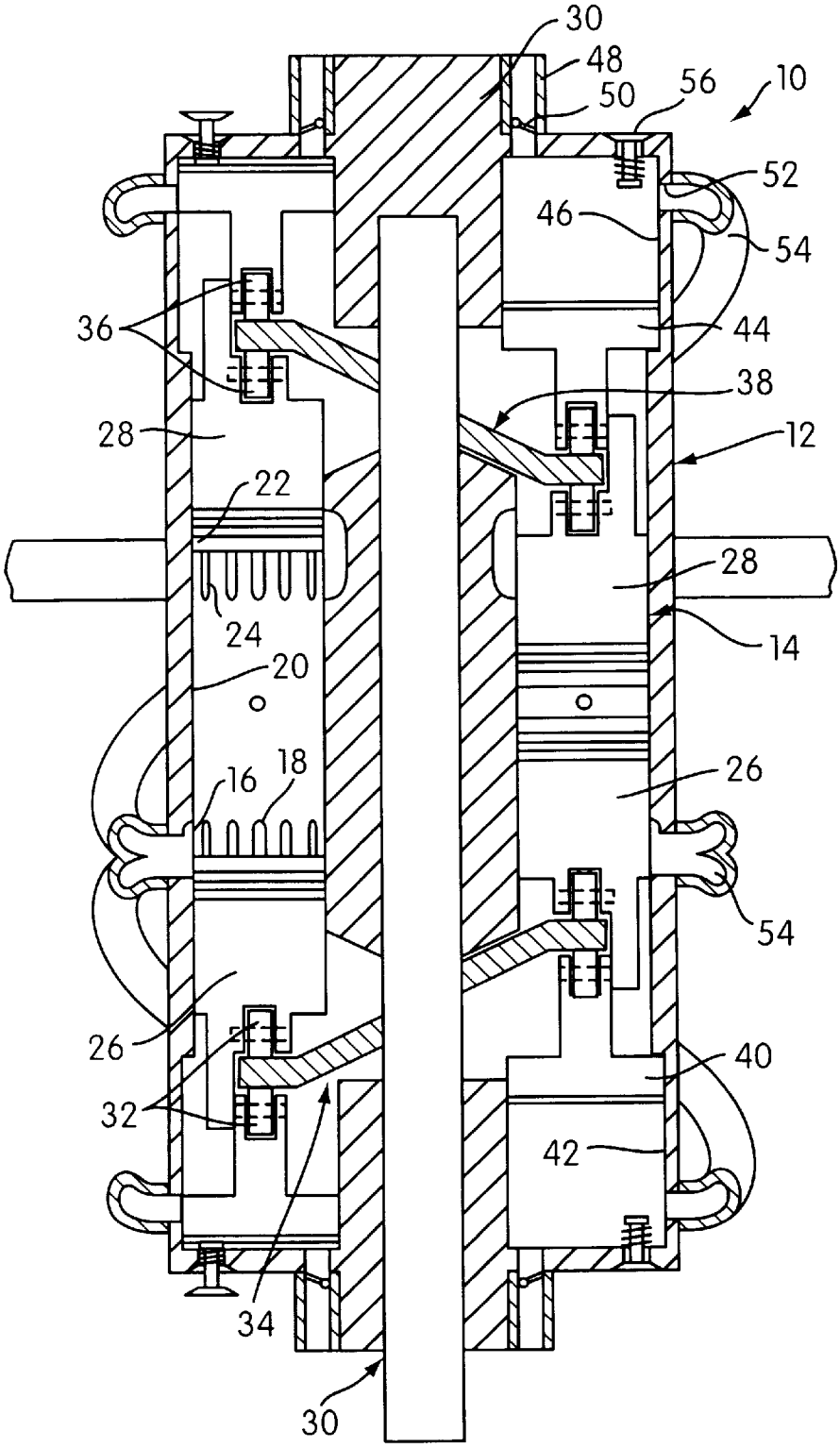
FIG. 1 is an axial sectional view of an internal combustion engine embodying the principles of the present invention.

Referring now more particularly to the drawings, there is shown therein an internal combustion engine, generally indicated at 10, which embodies the principles of the present invention. The engine 10 includes a housing, generally indicated at 12, within which there is provided four annularly arranged cylinder structures, generally indicated at 14, having axes which are parallel with a central rotor axis with respect to the housing 12. Each of the cylinders 14 has an inlet end portion 16 having one or more inlet ports 18 therein, a central working portion 20, and an outlet end portion 22 having one or more outlet ports 24 therein.

An inlet piston 26 is mounted in each cylinder 14 and is constructed and arranged to be moved in sealing relation thereto from an inlet end position wherein the inlet ports 18 thereof communicate with the working portion 20 thereof. Each inlet piston 26 moves in an axial direction away from the inlet end position into an inlet cut-off position wherein the inlet piston 26 cuts off communication of the inlet ports 18 of the associated cylinder 14 with the working portion 20 thereof and beyond into the working portion 20 thereof. An outlet piston 28 is mounted in each cylinder 14 and is constructed and arranged to be moved in sealing relation thereto from an outlet end position 22 wherein the outlet ports 24 thereof communicate with the working portion 20 thereof. Each outlet piston 28 moves in an axial direction away from the outlet end position into an outlet port cut-off position wherein the outlet piston 28 cuts off the communication of the outlet ports of the associated cylinder 14 with the working portion 20 thereof and beyond into the working portion 20 thereof.

A rotor structure, generally indicated at 30, is mounted within the housing 14 for rotational movement therein about the aforesaid central rotor axis. Each of the inlet pistons 26 includes an inlet cam follower in the form of a pair of axially spaced rollers 32 constructed and arranged to follow an annular inlet cam, generally indicated at 34, during the rotation of the rotor structure 30. Each of the outlet pistons 28 includes an outlet cam follower in the form of a pair of axially spaced rollers 36 constructed and arranged to follow an annular outlet cam, generally indicated at 38, during the rotation of the rotor structure 30.

The inlet and outlet annular cams 34 and 38 are configured to move the inlet and outlet pistons 26 and 28 within each cylinder 14 through a successive three-cycle repeating movement which includes (1) an operative power cycle wherein the inlet and outlet pistons are moved by the combustion of a combustible gas charge therein axially outwardly from the combustion positions until the gas charge is communicated with the outlet port by the outlet piston moving beyond the outlet port cut-off position thereof within the cylinder into the respective cut-off positions thereof defining a maximum volume condition, (2) a gas exchange cycle wherein the outlet and inlet pistons are moved between the respective cut-off positions thereof and the respective end positions thereof to enable a combusted gas charge to be exhausted through the open outlet port and a fresh gas charge to be moved through the open inlet port thereof, and (3) an operative compression cycle wherein the inlet and outlet pistons are moved toward one another beyond the respective port cut-off positions thereof into the combustion positions to trap a fresh gas charge and compress the same.

Each inlet piston 26 has fixed thereto an inlet pump piston 40 which slidably moves with the inlet piston 26 within an inlet pump chamber 42 formed in the inlet end of the housing 12. Similarly, each outlet pump piston 28 has fixed thereto an outlet pump piston 44 which slidably moves with the outlet piston 28 within an outlet pump chamber 46 formed in the outlet end of the housing 12. As shown, the inlet and outlet pump chambers 42 and 46 are cylindrical in shape, preferably having a diameter greater than the associated cylinder 14. Each associated pair of inlet and outlet pump chambers are co-axial with respect to one another and with the associated cylinder 14.

Operatively associated with each pump chamber 42 or 46 is cooperating pump structure in the form of an inlet tube 48 leading to each pump chamber 42 or 46 and having an inlet check valve 50 therein operable to allow gas to pass into the associated chamber 42 or 46 and to prevent the flow of gas outwardly from the pump chamber 42 or 46 to the inlet tube 48. Each cooperating pump structure also includes outlet ports 52 in the chamber wall. A conduit or tube 54 leads directly from the exterior of the outlet ports 52 of the associated chamber 42 and 46 in exterior communication with the inlet port 18 of another cylinder 14.

The outlet ports 52 are preferably positioned within each chamber 42 and 46 so as to be covered when the associated operative piston 26 or 28 is in the port cut-off position. This positioning makes it possible to provide for the flow of gases from the outlet ports 52 to the associated inlet port 18 through the associated conduit 54 without the restriction of a check valve, although in its broadest aspects the present invention contemplates the use of an appropriate check valve thereon. In the preferred embodiment shown, a position sensitive valve 56 is provided in the end of each chamber 42 or 46 which is engageable by the associated pump piston 40 or 44 when the associated operative piston 26 or 28 moves past the port cut-off position thereof.

Figure 2:
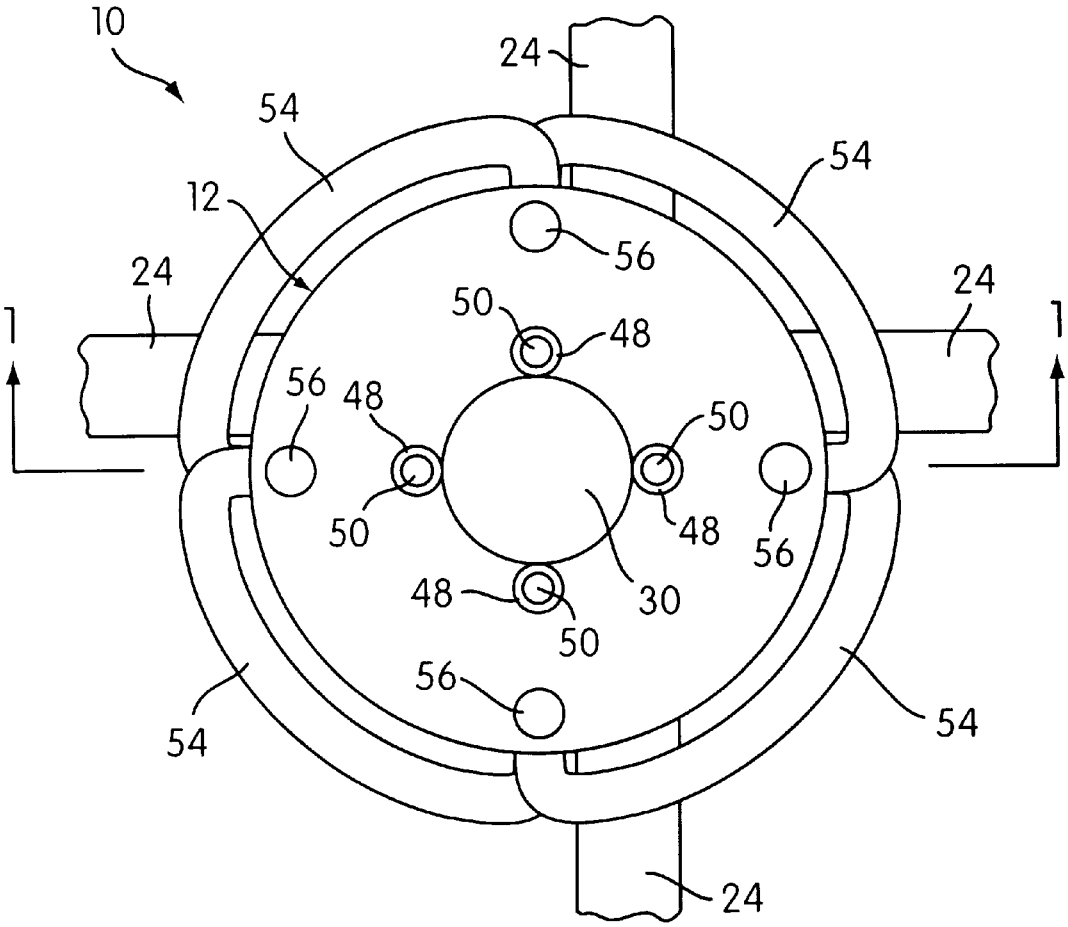
FIG. 2 is a top plan view of the engine shown in FIG. 1 illustrating the inter gas exchange between the pump pistons of each cylinder with the operating pistons of another.

In the embodiment shown in FIGS. 1–2, the pump pistons 40 and 44 associated with each cylinder 14 will be in a first limiting position near the associated inlet check valve when the associated operative piston 26 or 28 is in its end position. During the compression cycle movement of the operating pistons 26 and 28 inwardly toward one another, each associated pump piston 40 or 44 is moved from the first limiting position thereof into an opposite second limiting position through an intake stroke within the associated pump chamber 42 or 46 during which a fresh charge of gas is drawn into the pump chamber 42 or 46 through the associated inlet tube 48 past the associated inlet check valve 50.

During the ensuing power cycle movement of the corresponding operative pistons 26 and 28, as the pistons 26 and 28 move apart, the associated pump pistons 40 and 44 will be moved away from their second limiting position. This movement of the pump pistons 40 and 44 positively displaces the fresh gas charge taken into the pump chambers 42 and 46 outwardly through outlet ports 52 and into the associated conduits 54. The gas flowing into each conduit 54 is directed thereby into exterior communication with an inlet port 18 of another cylinder 14 undergoing a gas exchange cycle. The operative pistons 26 and 28 in the other cylinder 14 have moved into the gas exchange cycle thereof uncovering the associated inlet port 18 as well as the associated outlet port 24. The fresh gas charge displaced by the pumping movement of the pump pistons 40 and 44 into the associated conduit 54 is thus allowed to flow into the open inlet port 18 into the other cylinder 14 and then toward the open outlet port 24 thereof without a significant rise in pressure, thus displacing the spent gas charge therein outwardly through the open outlet port 24. Since the pump pistons 40 and 44 have a greater diameter than the operative pistons 26 and 28, the amount of gas displaced is greater than the volume within each cylinder 14 and hence there is enough displaced fresh gas to effect a full exchange and with some fresh gas passing through the open outlet port 24. For this reason, diesel operation or compression combustion is preferred where the fuel ingredient of the combustible gas charge is added at the end of the compression stroke. Spark ignition utilizing fuel injection during compression is also contemplated.

Figure 3:
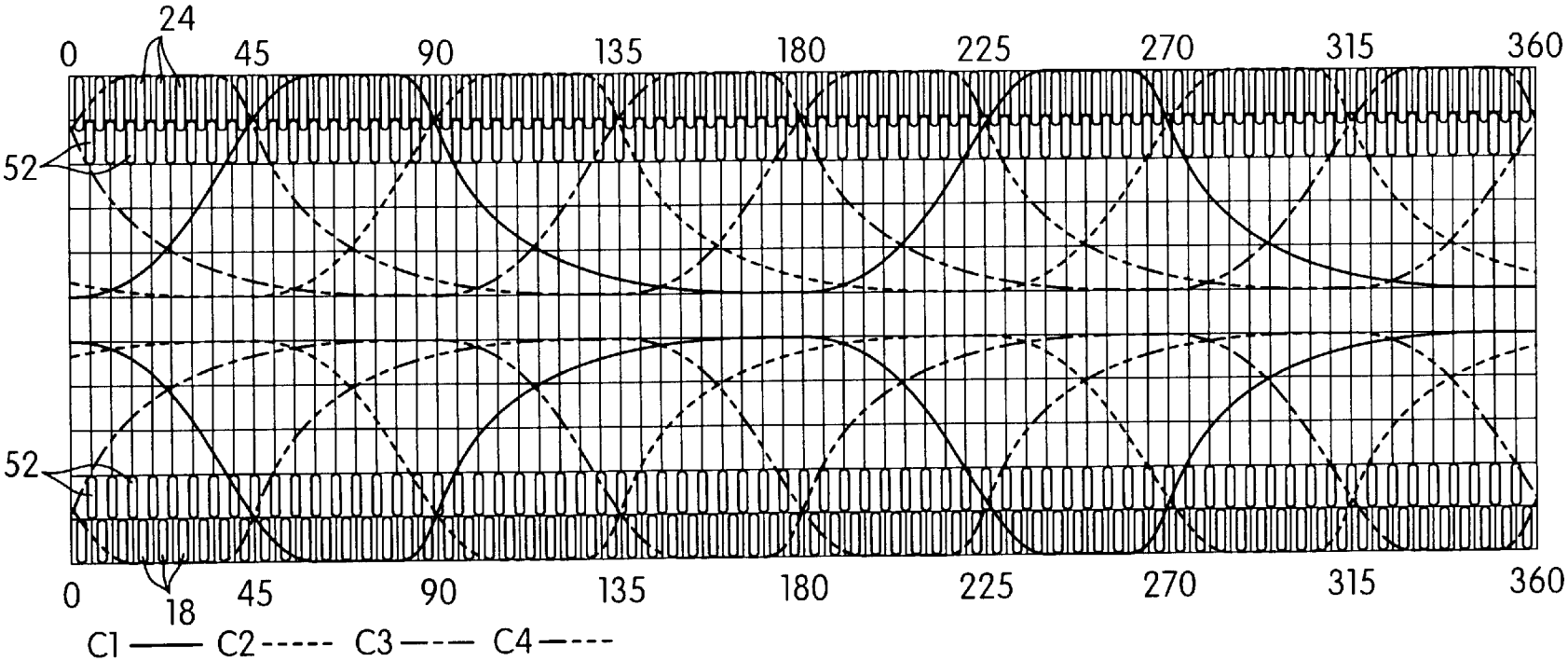
FIG. 3 is a layout drawing showing the configuration of the cam surfaces in relation to a single rotational movement of the rotor structure as it relates to the repetitive cyclical movements shown in the embodiment of FIGS. 1–2.

Referring now more particularly to FIG. 3, the pair of opposed lines C1 therein represent generally the working surfaces of the cams 34 and 38 and more particularly the movement of the opposed operating pistons 26 and 28 and the opposed pump pistons 40 and 44 associated with a first cylinder, and the pairs of opposed lines C2, C3 and C4 represent the piston movements in the other three cylinders, all interrelated in timed relation to one another. It will be noted that the pairs of opposed lines C1, C2, C3 and C4 are of the same shape and displaced 45° from each other. Each pair of opposed lines represents a power cycle movement, a gas exchange cycle movement and a compression cycle movement during each one-half rotation of the rotor structure 30. As shown, the power cycle movement and the gas exchange cycle movement are each performed in approximately 45° of turning movement of the rotor structure 30 while the compression cycle movement is performed in approximately 90° of turning movement.

In the embodiment shown, it will be noted that the start of the power cycle movement along the pair of opposed lines C2 begins with the start of the gas exchange cycle movement along the pair of opposed lines C1 and that the ending of the two movements is generally simultaneous. In this way, during the power cycle movement of the pump pistons 40 and 44, the cylinder 14 of associated piston movement lines C2 displace gas into the inlet port 18 of the cylinder 14 associated with piston movement lines C1. Thereafter, during the power cycle movement of the pump pistons 40 and 44 of the cylinder 14 associated with the piston movement lines C3 displace gas into the inlet port 18 of the cylinder 14 associated with the piston movement lines C2. Thereafter, during the power cycle movement of the pump pistons 40 and 44 of the cylinder 14 associated with the piston movement lines C4 displace gas into the inlet port 18 of the cylinder 14 associated with piston movement lines C3.

Finally, thereafter during the power cycle movement of the pump pistons 40 and 44 of the cylinder 14 associated with the piston movement lines C1 displace gas into the inlet port 18 of the cylinder 14 associated with the piston movement lines C4.

It will also be noted that each piston movement lines C1 and C4 varies from a simple harmonic motion configuration not only in the greater extent of the compression cycle movement as compared with the power cycle movement or gas exchange cycle movement but in the provision of dwell periods in the power cycle movement and the gas exchange cycle movement.

The dwell period in the gas exchange cycle movement is preferred in order to fully open the intake ports 18 as soon as practical and leave them fully opened as long as practical during the gas exchange cycle. This is particularly true since the outlet ports 52 of the pump chambers 42 and 46 are fully open as the power cycle movement begins. The pump outlet ports 52 progressively close as the power cycle ends and preferably the inlet ports 18 comparably progressively close at the end of the gas exchange cycle.

It will be noted that the end of the power cycle movement is signaled when the associated outlet piston 28 reaches the outlet port 24 cut-off position thereof. As shown, this is slightly before the associated inlet piston reaches the inlet port cut-off position thereof. This offset relationship ensures that the residual pressure in the associated cylinder 14 will be dumped through the opening outlet port 24 before opening the associated inlet port 20 to thereby prevent an elevated pressure condition within the cylinder being communicated with the inlet port 18 when opened. This arrangement is preferred because it makes it possible to keep the opposite operative pistons 26 and 28 moving at the same speeds in opposite directions to maintain engine balance. In its broadest aspects, angular displacement between the cams 34 and 38 can be used to secure the same result.

In accordance with the principles of the present invention, the dwell or substantial dwell at minimum volume or nearly so continues for a time period after ignition sufficient to enable maximum pressure to develop in the working portion 20 of the cylinder 14 before or substantially before the operative expansion or power cycle movement begins. In contrast, engines tied to simple harmonic motion begin the expansion cycle before the time necessary to ensure that maximum pressure can be established and the increase in volume at the beginning of the expansion cycle has the effect of limiting the maximum pressure that can be established during the beginning movements of the expansion cycle. This difference results in an increase in the work delivered to the rotor structure 30 of the engine 10. The dwell period can be as much as 20° of rotation which preferably occurs at the end of the compression cycle movement and before the start of the power cycle movement.

Figure 4:
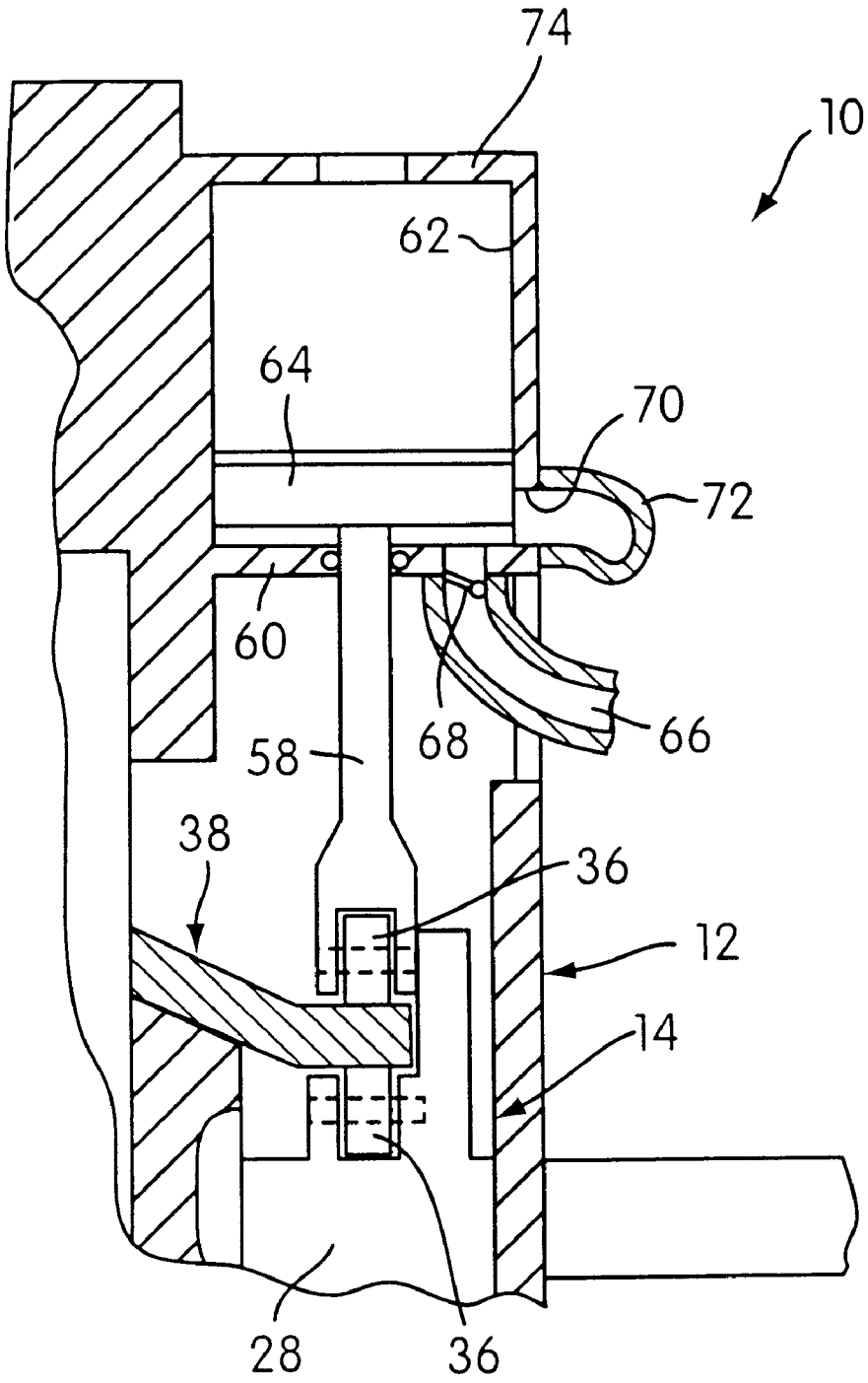
FIG. 4 is a fragmentary view similar to a fragment of FIG. 1 showing a modification in accordance with the principles of the present invention.

FIG. 4 shows a modification in the configuration of the pump pistons 40 and 44 which enable them to displace gas to the open inlet port 18 of another cylinder 14 during the compression cycle movement thereof rather than the power cycle movement as previously described. As shown, each operating piston 26 or 28 includes an elongated piston rod 58 fixed thereto and extending outwardly along the axis thereof. Each piston rod 58 slidably sealingly moves through a housing wall 60 forming one end of an enlarged outwardly open cylindrical pump chamber 62 formed in the housing 12 in outward coaxial relation with respect to the associated cylinder 14. Slidably sealingly mounted within each pump cylinder 62 is a pump piston 64 fixed to the outer end of the associated piston rod 58. Each pump piston 64 is therefore fixed with respect to an associated operative piston 26 or 28 to move therewith within the associated pump chamber 62. Each pump chamber 62 has an inlet tube 66 leading thereto which communicates with the pump chamber 62 through the associated wall 60 and an inlet check valve 68 mounted therein. The peripheral wall defining each pump chamber 62 has a series of outlet ports 70 formed therein adjacent the wall 60 and a conduit 72 leads from the exterior of each outlet port 70 to the exterior of an inlet port 18 of another cylinder 14.

Figure 5:
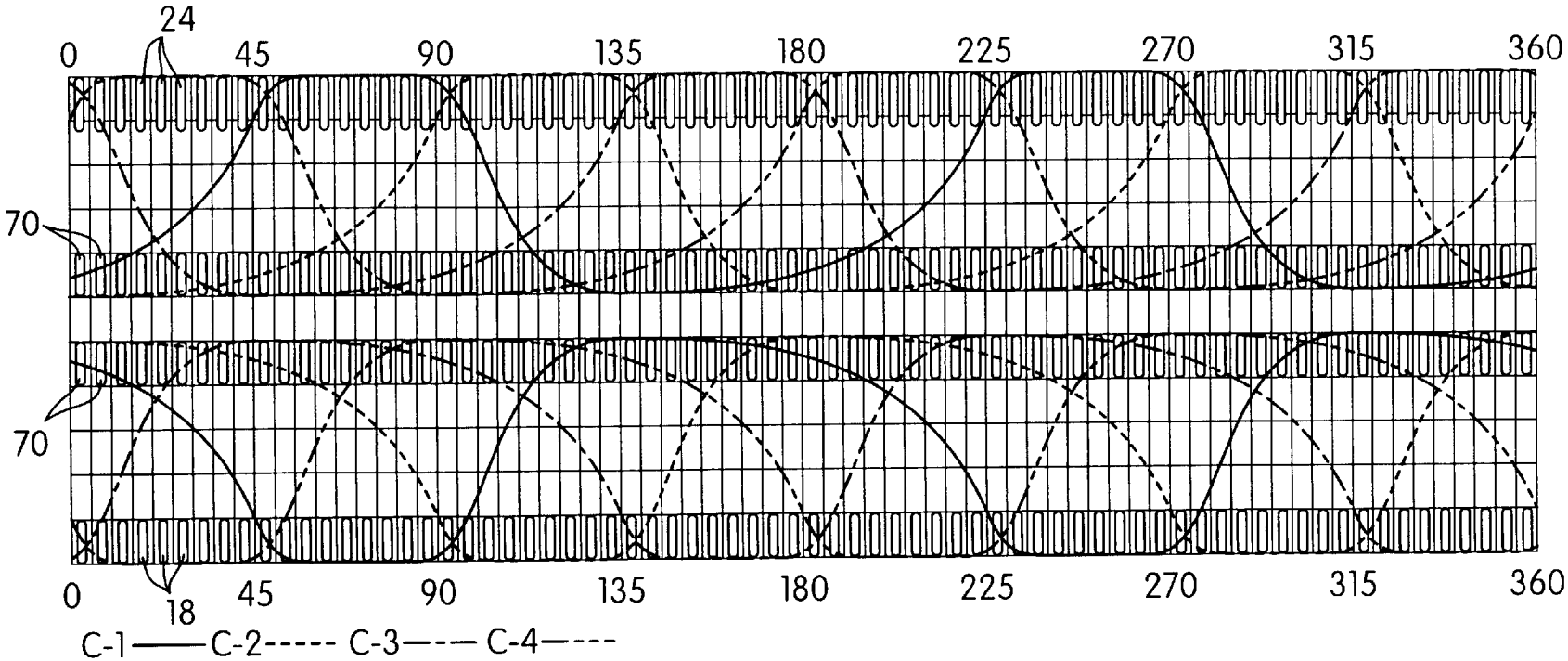
FIG. 5 is a view similar to FIG. 3 relating to the modification of FIG. 4.

FIG. 5 shows the modification in the shape of the annular cams 34 and 38 necessary in order to pump on the compression cycle movement rather than the power cycle movement. As shown, the compression cycle movement is made to be generally equal to the gas exchange cycle movement in rotational extent while the rotational extent of the power stroke is increased from being generally equal to the rotational extent of the gas exchange cycle movement to generally double of the rotational extent of the gas exchange cycle movement. The change in the pump construction results in the intake stroke of each pump piston 64 coinciding with the outward movement of the associated operative piston 26 and 28 or the power cycle movement thereof of the pumping stroke of each pump piston 64 coinciding with the inward movement of the associated operative piston 26 or 28 or the compression cycle movement thereof.

With the above in mind, it can be seen from FIG. 5 that the pump pistons 64 of the cylinder 14 associated with the piston movement lines C4 displace gas from the pump chambers 62 through conduits 66 to the inlet port 18 of the cylinder associated with piston movement lines C1. In addition, C1 feeds to C2, C2 feeds to C3 and C3 feeds to C4. In this embodiment, the dwell during combustion is considered to be a part of the power cycle.

Figure 6:
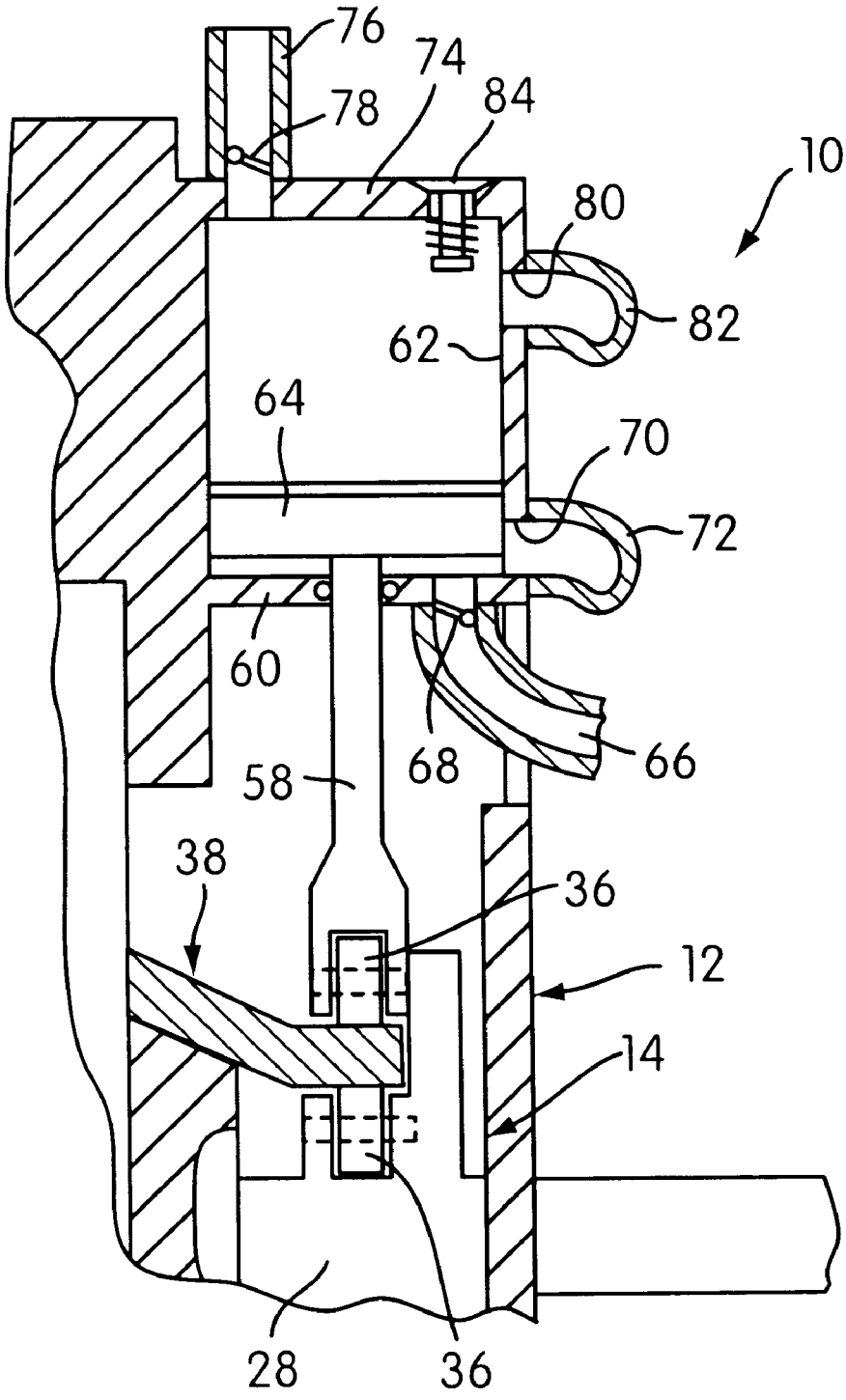
FIG. 6 is a view similar to FIG. 5 showing another modification in accordance with the principles of the present invention.

FIG. 6 shows still another embodiment which is particularly adapted for a six-cylinder engine (or any multiple of three). FIG. 6 utilizes the pump piston modification of FIG. 4 except that rather than utilizing pump chambers 62 which are open at their outer ends, the pump chambers 62 are made double-acting. Thus, instead of an open outer wall, an outer wall 74 is provided which includes an inlet tube 76 having an inlet check valve 78 similar to the inlet tube 48 and check valve 50. The peripheral wall defining each pump chamber 62 is formed with a series of outlet ports 80 having conduits 82 leading from the exterior thereof to the inlet port 18 of another cylinder 14. As before, a piston-actuated position sensitive valve 84 similar to the valve 56 previously described is also provided.

It will be evident that each pump piston 64 in the embodiment of FIG. 6 undergoes an intake stroke within the pump chamber 62 on one side of the pump piston 64 while simultaneously undergoing a pumping stroke within the pump chamber 62 on the other side of the pump piston. Consequently, each pump piston 64 during each power cycle movement displaces gas to the inlet port 18 of another cylinder and during each power cycle movement displaces gas to still another inlet port 18 of still another cylinder.

Figure 7:
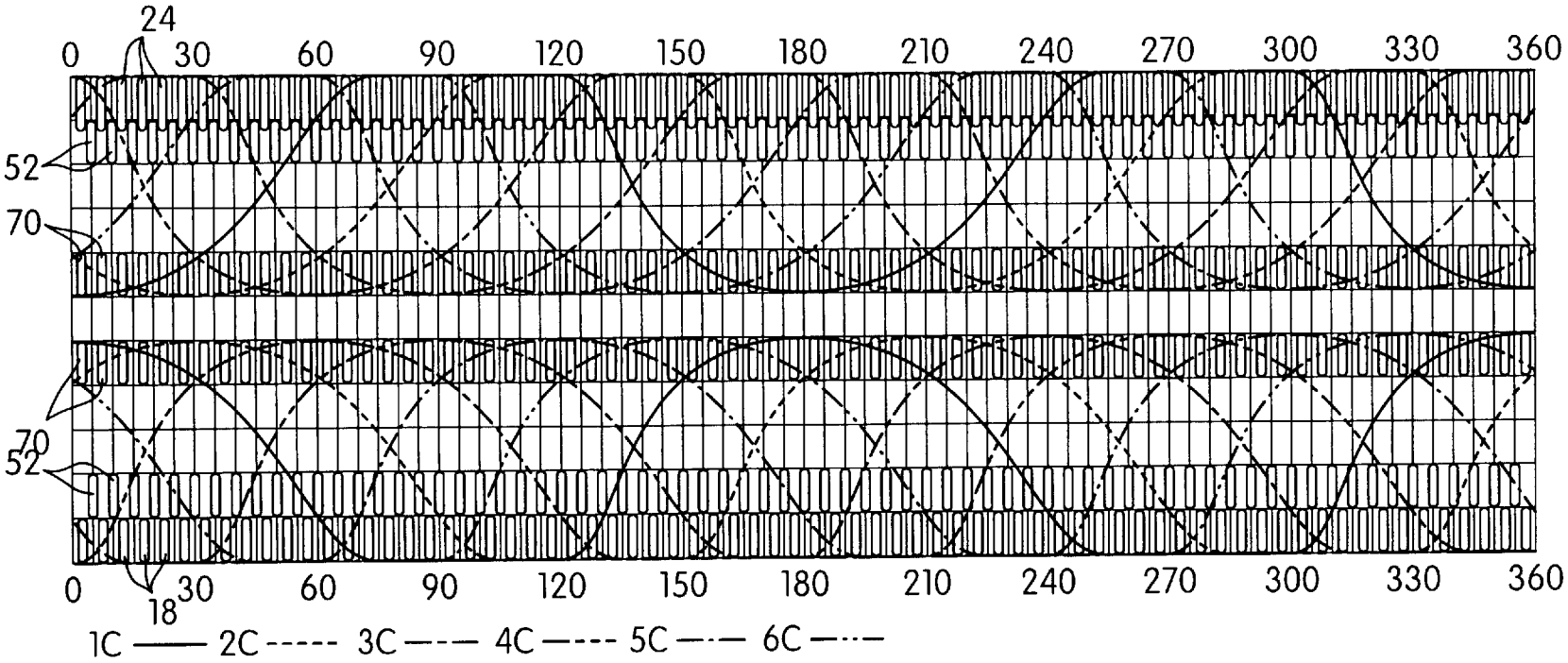
FIG. 7 is a view similar to FIG. 3 relating to the modification of FIG. 6.

FIG. 7 shows the modifications required in the configuration of the cams 34 and 38 in order to coordinate the inter-gaseous exchange between the cylinders of a six-cylinder engine. In FIG. 7, the coordinated movement of the six cylinders 14 are represented by the pairs of opposed movement lines 1C, 2C, 3C, 4C, 5C and 6C. The modification of the cams 34 and 38 results essentially in all three of the cycle movements having generally the same rotational extent. The coordinated pumping action is such that, during the gas exchange cycle of the operating pistons 26 and 28 of the cylinder 14 associated with piston movement lines 1C, the pump pistons 64 of the cylinder 14 associated with piston movement lines 2C are displacing gas to the inlet port 18 thereof during the power cycle movement of the operative pistons 26 and 28 of the cylinder associated with the piston movement lines 6C displace gas to the inlet port 18 thereof during the compression cycle movement of the operative pistons 26 and 28 of the cylinder 18 associated with the piston movement lines 6C. The remaining relationships are as follows: 2C receives from 3C (power) and 1C (compression); 3C receives from 4C (power) and 2C (compression); 4C receives from 5C (power) and 3C (compression); 5C receives from 6C (power) and 4C (compression); and 6C receives from 1C (power) and 5C (compression). Clearly, it would be possible to pump only on compression or only on power rather than both simultaneously.

The combustion dwell is shown as being included in the last 20° of movement of the compression stroke, although it could be included as the first 20° of the power stroke or split between them.

What is claimed is:

1. An internal combustion engine comprising a housing, a structure within said housing defining a plurality of spaced cylinders with their axes parallel, each of said cylinders including an inlet end portion having an inlet port therein, a central working portion and an outlet end portion having an outlet port therein, an inlet piston mounted in each cylinder constructed and arranged to be moved in sealing relation to the associated cylinder from an inlet end position wherein the inlet port thereof communicates with the working portion thereof in an axial direction away from said inlet end position into an inlet port cut-off position wherein said inlet piston cuts off communication of the inlet port thereof with the working portion thereof and beyond into the working portion thereof, an outlet piston mounted in each cylinder constructed and arranged to be moved in sealing relation to the associated cylinder from an outlet end position wherein the outlet port thereof is communicated with the working portion thereof in an axial direction away from said outlet end position into an outlet port cut-off position wherein said outlet piston cuts off the communication of the outlet port thereof with the working portion thereof and beyond into the working portion thereof, an output shaft carried by said housing for rotational movement with respect thereto, an inlet motion transmitting mechanism drivingly connected between said output shaft and each inlet piston for causing each inlet piston to move cyclically between the inlet end position thereof and a combustion position within the associated cylinder thereof in conjunction with the rotational movement of said output shaft, an outlet motion transmitting mechanism drivingly connected between said output shaft and each outlet piston for causing each outlet piston to move cyclically between the outlet end position thereof and a combustion position within the associated cylinder thereof in conjunction with the rotational movement of said output shaft, said inlet and outlet motion transmitting mechanisms being interrelated and configured to move the inlet and outlet pistons within each cylinder through a successive three cycle repeating movement which includes (1) an operative power cycle wherein said inlet and outlet pistons are moved by the combustion of a combustible gas charge therein axially outwardly from said combustion positions until the gas charge is communicated with the outlet port by said outlet piston moving beyond the outlet port cut-off position thereof, (2) a gas exchange cycle wherein said outlet and inlet pistons are moved between the respective cut-off positions thereof and the respective end positions thereof to enable a combusted gas charge to be exhausted through the open outlet port and a fresh gas charge to be moved through the open inlet port thereof, and (3) an operative compression cycle wherein said inlet and outlet pistons are moved toward one another beyond the respective port cut-off positions thereof into said combustion positions to trap a fresh gas charge and compress the same, said inlet and outlet pistons having pump piston structure fixed to move therewith associated with each of said cylinders, cooperating pump structure operatively associated with said pump piston structure constructed and arranged to cause a fresh charge of gas to be displaced by the pump piston structure associated with each cylinder during an operative cycle of the associated pistons therein and confined to move directly into the open inlet port of one other cylinder generally simultaneously with the gas exchange cycle of the inlet and outlet pistons associated therewith so as to thereby effect the exchange of the combusted gases therein with a fresh charge under relatively low pressure conditions during a time period which is generally equal to the time of said operative cycle.

2. The internal combustion engine as defined in claim 1 wherein said output shaft is mounted within said housing for rotational movement about a central axis and said cylinders are spaced annularly about said central axis with the axes thereof parallel with said central axis.

3. The internal combustion engine as defined in claim 2 wherein said inlet motion-transmitting mechanism comprises an annular inlet cam fixed to rotate with said output shaft and an inlet cam follower connected with each inlet piston mounted in following relation with said annular inlet cam, said outlet motion-transmitting mechanism comprising an annular outlet cam fixed to rotate with said output shaft and an outlet cam follower connected with each outlet piston mounted in following relation to said annular outlet cam.

4. The internal combustion engine as defined in claim 3 wherein the pump piston structure associated with each cylinder includes a first pump piston fixed to the inlet piston of the associated cylinder and a second pump piston fixed to the outlet piston of the associated cylinder.

5. The internal combustion engine as defined in claim 4 wherein the number of cylinders and said inlet and outlet annular cams are related so that the power cycle and the gas exchange cycle being carried out in each cylinder are each substantially equal parts of the three-cycle movement in which the number of cylinders determines the total number of such substantially equal parts in the three-cycle movement.

* * * * *